US005662134A

United States Patent [19]

Auer

[11] Patent Number: 5,662,134

[45] Date of Patent: Sep. 2, 1997

[54] TENT APPARATUS

[76] Inventor: Martti Z. H. Auer, Mellingebacken, 12.NB., 16364 Spånga, Sweden

[21] Appl. No.: 717,686

[22] Filed: Sep. 23, 1996

[51] Int. Cl.[6] ..... E04H 15/42

[52] U.S. Cl. ..... 135/156; 135/158; 135/118

[58] Field of Search ..... 135/90, 128, 156, 135/158, 160, 114, 115, 118

[56] References Cited

U.S. PATENT DOCUMENTS

| | | | |
|---|---|---|---|
| 4,198,997 | 4/1980 | Miller | 135/90 |
| 4,597,401 | 7/1986 | Fournier | 135/90 |
| 4,719,934 | 1/1988 | Mydans | 135/90 |
| 4,838,293 | 6/1989 | Novak | 135/156 X |

FOREIGN PATENT DOCUMENTS

| | | | |
|---|---|---|---|
| 30559 | 10/1922 | Denmark | 135/117 |
| 677066 | 6/1939 | Germany | 135/156 |
| 53475 | 1/1934 | Norway | 135/117 |
| 18814 | 8/1914 | United Kingdom | 135/156 |

*Primary Examiner*—Lanna Mai

[57] ABSTRACT

A tent apparatus includes a pole-support assembly which includes a ground-penetration member, a pole-receiving member connected to the ground-penetration member, and a ground-stabilizing assembly connected between the ground-penetration member and the pole-receiving member. A first portion of the ground-stabilizing assembly is oriented with respect to the ground-penetration member at an acute first orientation angle. A second portion of the ground-stabilizing assembly is oriented with respect to the ground-penetration member at an obtuse second orientation angle. The first orientation angle and the second orientation angle provide a straight angle when added together. A pole assembly includes a plurality of interfitting pole segments, and a proximal pole segment is received in the pole-receiving member. A distal pole portion is located at a distal end of the pole assembly. A plurality of suspension cables are connected to the distal pole portion. A plurality of primary stakes are connected to ends of the suspension cables. The primary stakes are driven into a portion of the ground, and a flexible sheet assembly is draped over the suspension cables to form an erected tent apparatus. Sheet-tensioning cables are connected to the sheet assembly, and sheet-tensioning stakes are connected to ends of the sheet-tensioning cables and driven into a portion of the ground. The pole-receiving member is connected to the ground-penetration member along a common longitudinal axis. The sheet assembly includes front flap portions which form a door.

8 Claims, 3 Drawing Sheets

FIG 1
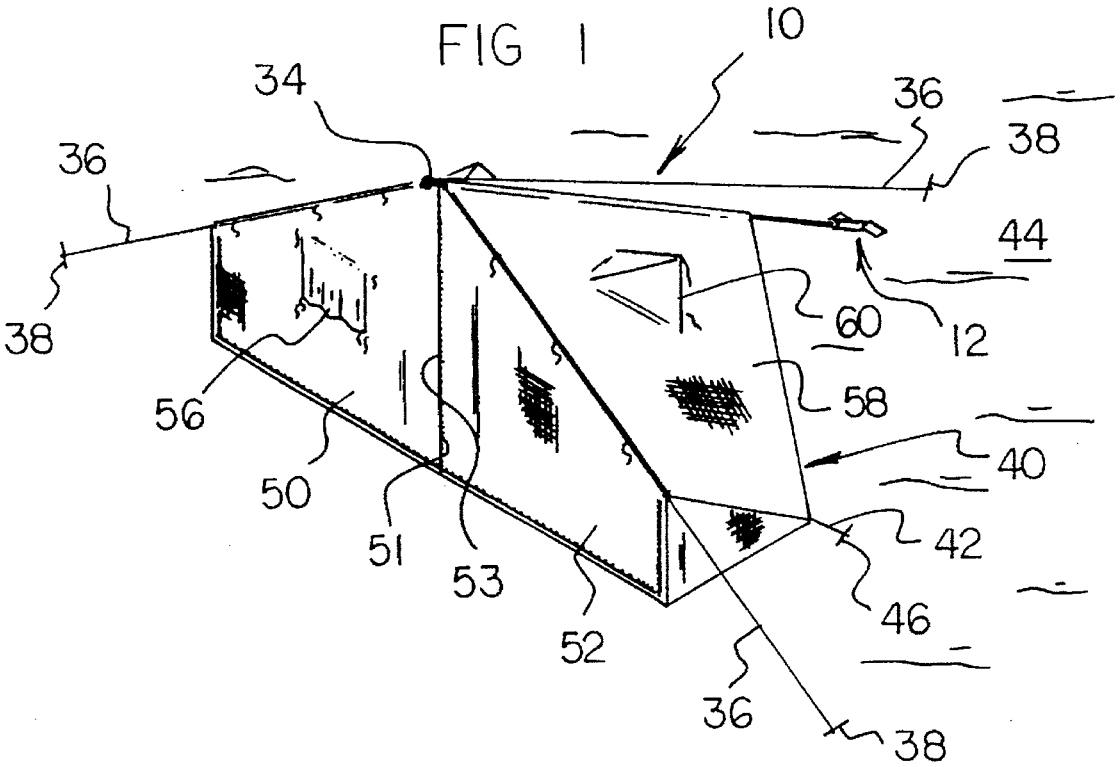
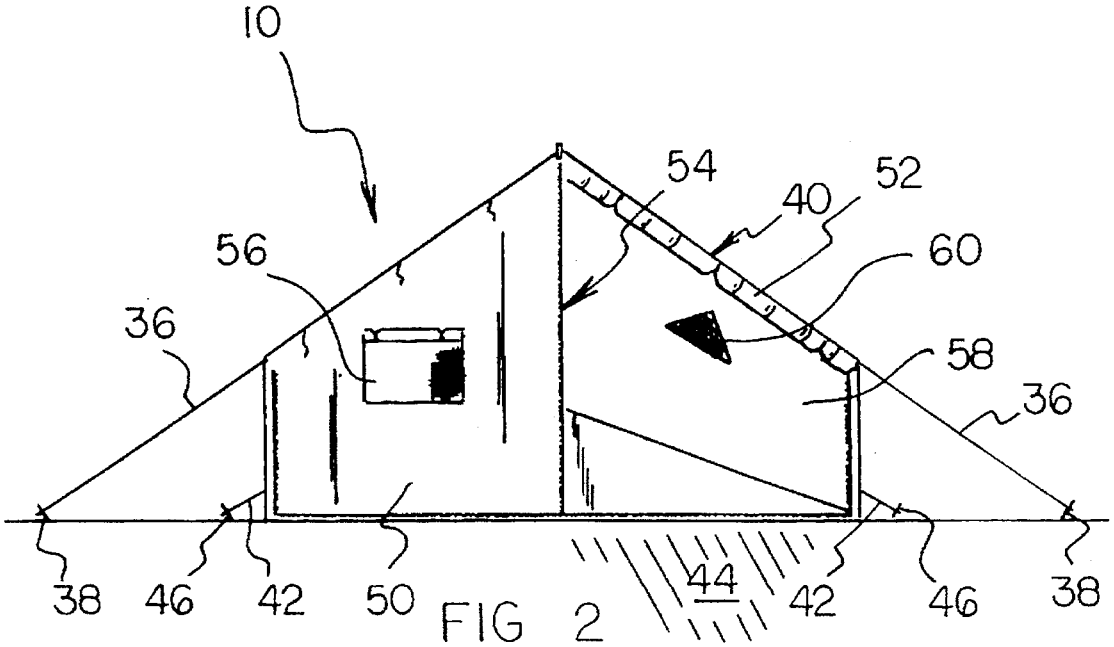
FIG 2

TENT APPARATUS

BACKGROUND OF THE INVENTION

1. Field of the Invention

The present invention relates generally to tent devices and, more particularly, to tent devices that are portable and easily carried by hikers and other outdoorsmen.

2. Description of the Prior Art

When overnight hikes are taken, often the hiker carries along a portable tent device that can be erected at a campsite. Throughout the years, a number of innovations have been developed relating to portable tents, and the following U.S. patents are representative of some of those innovations: U.S. Pat. Nos. 3,931,918, 4,109,424, 4,471,794, 4,526,307, and Des. 260,277. More specifically, U.S. Pat. No. 3,931,918 discloses a back pack that is convertible into a tent. The roof of the tent is supported by a horizontal rod which is supported by four slanting rods, two at the front of the tent and two at the rear of the tent. Thus, five rods are needed to support this tent. To decrease the carrying weight and to decrease assembly time, it would be desirable if a portable tent device were provided that includes considerably less than five support rods.

U.S. Pat. No. 4,109,424 discloses a portable tent that employs an inflatable front support structure. If the inflatable structure is somehow nicked, the support structure would be unusable. In this respect, it would be desirable if a portable tent device were provided which does not employ an inflatable support structure.

U.S. Pat. No. 4,471,794 discloses a tent device that is simulative of a hammock structure which is suspended at two ends. In the field, it may be difficult to find two nearby structures, such as trees, from which a hammock can be suspended. In this respect, it would be desirable if a portable tent device were provided which does not need to suspended from both ends to serve as a hammock structure.

U.S. Pat. No. 4,526,307 discloses a portable tent which is suspended from a tree. In the outdoors, strong trees are not always available from which a portable tent can be suspended. In this respect, it would be desirable if a portable tent device were provided which is not suspended from a tree.

U.S. Pat. No. Des. 260,277 discloses a tent which discloses a single, arch-shaped tent support that is supported on the ground at two ends of the arch. When an arch-shaped support structure is disassembled, curved arch components may be relatively difficult to store when carried because curved components take up considerably more storage space than straight structural components. In this respect, it would be desirable if a portable tent device were provided which does not employ arch-shaped structural components. In addition, U.S. Pat. No. 4,662,132 may be of interest for its disclosure of collapsible support.

Still other features would be desirable in a tent apparatus. For example, a portable tent is often used as a lean-to type of tent wherein a front opening is relatively large, and the tent tapers back from the large front opening to a relatively small rear of the tent. To provide easy access to such a tent, it would be desirable if the front of the tent were not obstructed by any tent support structures.

It is well known that some tents are supported on the ground by vertically oriented tent posts that support the tent from inside the tent and, therefore, take up floor space in the tent. In this respect, it would be desirable if a portable tent device were provided that is supported in a way that does not take up floor space inside the tent.

Often, a campfire and the front opening of a tent are arranged so that a portion of heat and light from the campfire will enter the tent. To maximize the use of heat and light that enter a tent; it would be desirable if a ceiling of a tent were provided that reflects heat and light from a campfire down onto a person lying inside the tent.

Thus, while the foregoing body of prior art indicates it to be well known to use tent devices, the prior art described above does not teach or suggest a tent apparatus which has the following combination of desirable features: (1) includes considerably less than five support rods; (2) does not employ an inflatable support structure; (3) does not need to be suspended from both ends and does not serve as a hammock structure; (4) is not suspended from a tree; (5) does not employ arch-shaped structural components; (6) has a tent front that is not obstructed by tent support structures; (7) is supported in a way that does not take up floor space inside the tent; and (8) reflects heat and light from a campfire down onto a person lying inside the tent. The foregoing desired characteristics are provided by the unique tent apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a tent apparatus which includes a pole-support assembly which includes a ground-penetration member, a pole-receiving member connected to the ground-penetration member, and a ground-stabilizing assembly connected between the ground-penetration member and the pole-receiving member. A first portion of the ground-stabilizing assembly is oriented with respect to the ground-penetration member at an acute first orientation angle. A second portion of the ground-stabilizing assembly is oriented with respect to the ground-penetration member at an obtuse second orientation angle. A pole assembly includes a plurality of interfitting pole segments, and a proximal pole segment is received in the pole-receiving member. A distal pole portion is located at a distal end of the pole assembly. A plurality of suspension cables are connected to the distal pole portion. A plurality of primary stakes are connected to ends of the suspension cables. The primary stakes are driven into a portion of the ground, and a flexible sheet assembly is draped over the suspension cables to form an erected tent apparatus.

The ground-penetration member is in a form of a V-shaped blade. Sheet-tensioning cables are connected to the sheet assembly, and sheet-tensioning stakes are connected to ends of the sheet-tensioning cables. The sheet-tensioning stakes are driven in a portion of the ground. The pole-receiving member is connected to the ground-penetration member along a common longitudinal axis. The first orientation angle and the second orientation angle provide a straight angle when added together.

The sheet assembly includes a first front flap portion which has a first flap edge, a second front flap portion which has a second flap edge, and a connection assembly for connecting the first flap edge to the second flap edge. Either the first front flap portion or the second front flap portion includes a window flap. The sheet assembly includes a roof portion which includes a vent portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tent apparatus which has all of the advantages of the prior art and none of the disadvantages.

It is another object of the present invention to provide a new and improved tent apparatus which may be easily and efficiently manufactured and marketed.

It is a further object of the present invention to provide a new and improved tent apparatus which is of durable and reliable construction.

An even further object of the present invention is to provide a new and improved tent apparatus which is susceptible of a low cost of manufacture with regard to both materials and labor, mid which accordingly is then susceptible of low prices of sale to the consuming public, thereby making such tent apparatus available to the buying public.

Still yet a farther object of the present invention is to provide a new and improved tent apparatus which includes considerably less than five support rods.

Still another object of the present invention is to provide a new and improved tent apparatus that does not employ an inflatable support structure.

Yet another object of the present invention is to provide a new and improved tent apparatus which does not need to be suspended from both ends and does not serve as a hammock structure.

Even another object of the present invention is to provide a new and improved tent apparatus that is not suspended from a tree.

Still a further object of the present invention is to provide a new and improved tent apparatus which does not employ arch-shaped structural components.

Yet another object of the present invention is to provide a new and improved tent apparatus that has a tent front that is not obstructed by tent support structures.

Still another object of the present invention is to provide a new and improved tent apparatus which is supported in a way that does not take up floor space inside the tent.

Yet another object of the present invention is to provide a new and improved tent apparatus that reflects heat and light from a campfire down onto a person lying inside the tent.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the tent apparatus of the invention erected on a ground surface.

FIG. 2 is a front view of the embodiment of the tent apparatus shown in FIG. 1, wherein a door is partially open.

DESCRIPTION OF THE PREFERRED EMBODIMENT

With reference to the drawings, a new and improved tent apparatus embodying the principles and concepts of the present invention will be described.

Figure 3:
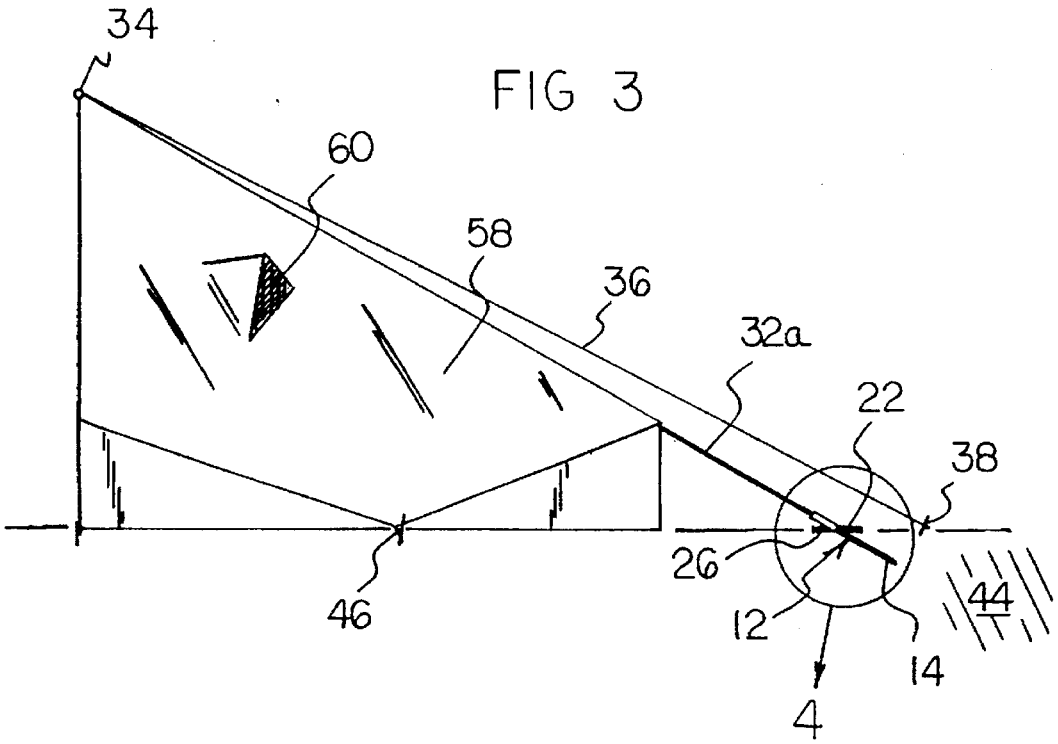
FIG. 3 is a side view of the embodiment of the tent apparatus shown in FIG. 2.
Figure 4:
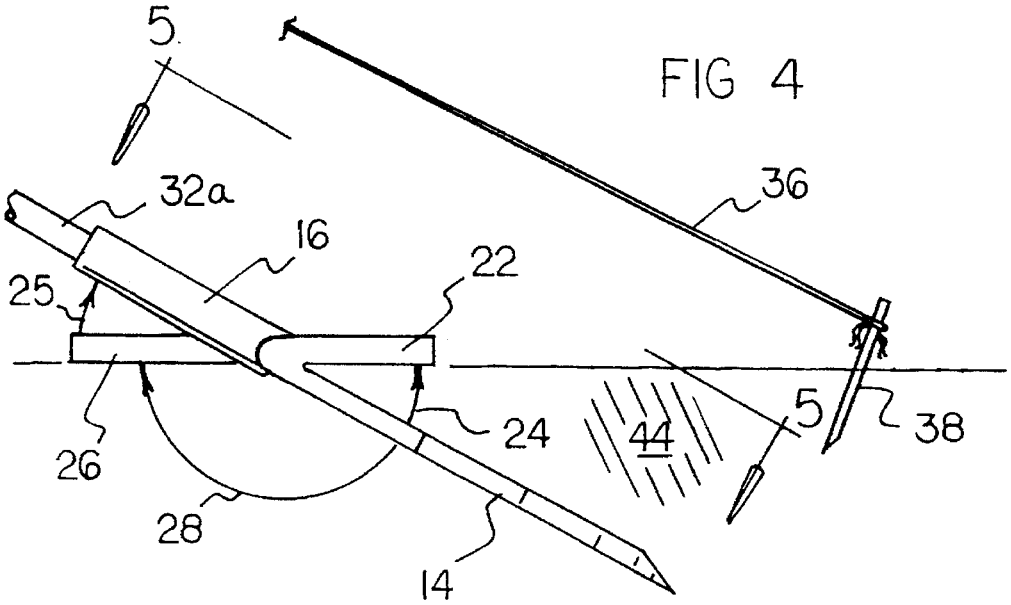
FIG. 4 is an enlarged side view of a portion of the embodiment of the invention shown in FIG. 3 contained in circled region 4 of FIG. 3.
Figure 5:
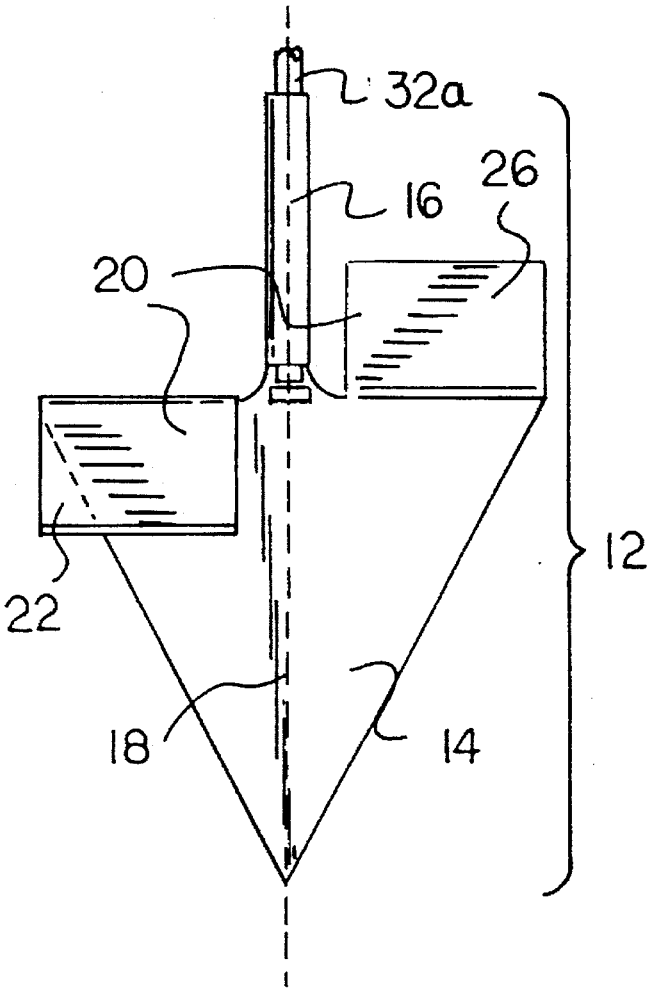
FIG. 5 a top view of a portion of the embodiment of the invention shown in FIG. 4 taken along line 5—5 of FIG. 4.
Figure 6:
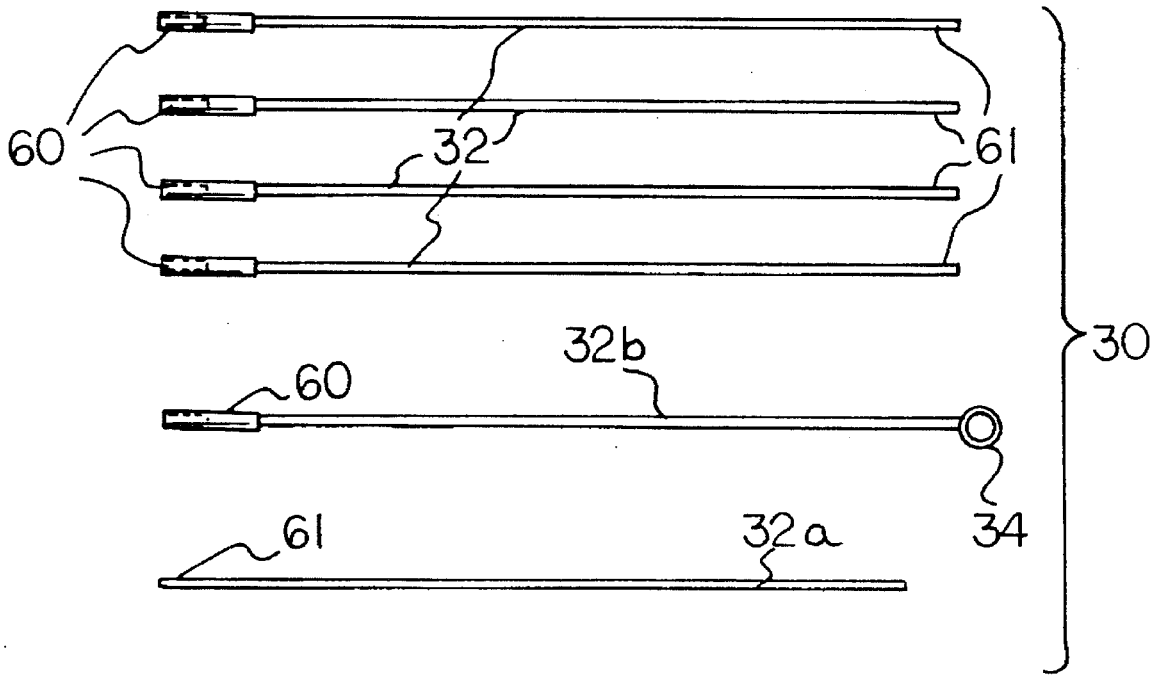
FIG. 6 is a top view of a collapsible single support rod structure for the tent apparatus of the invention.

Turning to FIGS. 1–6, there is shown an exemplary embodiment of the tent apparatus of the invention generally designated by reference numeral 10. In its preferred form, tent apparatus 10 includes a pole-support assembly 12 which includes a ground-penetration member 14, a pole-receiving member 16 connected to the ground-penetration member 14, and a ground-stabilizing assembly 20 connected between the ground-penetration member 14 and the pole-receiving member 16. A first portion 22 of the ground-stabilizing assembly 20 is oriented with respect to the ground-penetration member 14 at an acute first orientation angle 24. A second portion 26 of the ground-stabilizing assembly 20 is oriented with respect to the ground-penetration member 14 at an obtuse second orientation angle 28. A pole assembly 30 includes a plurality of interfitting pole segments 32, and a proximal pole segment **32*a* is received in the pole-receiving member 16. A distal pole portion 34 located at a distal end of the pole assembly 30. A plurality of suspension cables 36 are connected to the distal pole portion 34. A plurality of primary stakes 38 are connected to ends of the suspension cables 36. The primary stakes 38 are driven into a portion of the ground 44, and a flexible sheet assembly 40 is draped over the suspension cables 36 to form an erected tent apparatus 10**.

The ground-penetration member 14 is in a form of a V-shaped blade. Sheet-tensioning cables 42 are connected to the sheet assembly 40, and sheet-tensioning stakes 46 are connected to ends of the sheet-tensioning cables 42. The sheet-tensioning stakes 46 are driven in a portion of the ground 44. The pole-receiving member 16 is connected to the ground-penetration member 14 along a common longitudinal axis 18. The first orientation angle 24 and the second orientation angle 28 provide a straight angle when added together.

The sheet assembly 40 includes a first front flap portion 50 which has a first flap edge 51, a second front flap portion 52 which has a second flap edge 53, and a connection assembly 54 for connecting the first flap edge 51 to the second flap edge 53. The connection assembly 54 can be in a form of a zipper. Buttons or snaps can also used for the connection assembly 54. Either the first front flap portion 50 or the second front flap portion 52 includes a window flap 56. The sheet assembly 40 includes a roof portion 58 which includes a vent portion 60.

In using the tent apparatus 10 of the invention, the tent apparatus 10 can be carried in a storage or carrying mode. In this mode, the pole segments 32 of the pole assembly 30 are disassembled. In addition, the pole-support assembly 12 is disconnected from the pole assembly 30. Also, the distal pole portion 34, the suspension cables 36, the primary stakes 38, the sheet assembly 40, the sheet-tensioning cables 42, and the sheet-tensioning stakes 46 are disconnected from each other, and all of the components are packed up into carrying bag (not shown) for transport to a campsite. When a suitable campsite is reached, the various components of the tent apparatus 10 are removed from the carrying bag (which can be a backpack), and the components are assembled into a tent mode as described below.

The pole-support assembly 12 is driven into the ground 44 such that the ground-penetration member 14 enters the ground 44 at an first orientation angle 24. In this way, the first portion 22 and the second portion 26 of the ground-stabilizing assembly 20, which are oriented with respect to one another at a straight angle, are parallel to the top surface of the ground 44. One end of the pole segment **32*a* is placed into the pole-receiving member 16. In succession, female ends 60 are placed on male ends 61 of successive pole segments 32. Finally, the female end 60 of the topmost pole segment 32*b*, which includes the distal pole portion 34, is placed in connection with the male end 61 of the next-to-last pole segment 32. In this way, the pole assembly 30** is completely assembled.

Then, one end of each of the suspension cables 36 is connected to the distal pole portion 34. At appropriate positions on the ground 44, the primary stakes 38 are driven into the ground 44, and the other ends of the suspension cables 36 are connected to the primary stakes 38. The positions of the primary stakes 38 in the ground 44 are provided so that the suspension cables 36 have appropriate tension for supporting the sheet assembly 40 which is draped over the pole assembly 30 and two front suspension cables 36. To increase tension on the sheet assembly 40, sheet-tensioning cables 42 and sheet-tensioning stakes 46 are provided.

As shown in FIG. 1, both the first front flap portion 50 and the second front flap portion 52 of the sheet assembly 40 are down, forming a closed door for the tent apparatus 10. As shown in FIG. 2, the second front flap portion 52 has been rolled up, providing a partially opened door for the tent apparatus 10.

Because the pole-receiving member 16 and the ground-penetration member 14 lie on the same longitudinal axis 18, and because the first portion 22 of the ground-stabilizing assembly 20 is oriented at a first orientation angle 24 with respect to the ground 44, the pole assembly 30 is oriented at an equal orientation angle 25 with respect to the second portion 26 of the ground-stabilizing assembly 20. As a result, the roof portion 58 of the sheet assembly 40 is oriented at the orientation angle 25 with respect to the ground 44, Consequently, when a tent apparatus 10 of the invention is placed before a camp fire, and when one or more of the first from flap portion 50 or the second from flap portion 52 is opened, heat and light from the camp fire are received on the inside surface of the roof portion 58 and reflected downward into the interior of the tent apparatus 10. It is noted that when a plurality of tent apparatuses 10 of the invention are arrayed in a circular fashion around a single camp fire, then each of the tent apparatuses 10 can receive heat and light from the camp fire in the manner described above. The tent apparatus 10 of the invention is easily disassembled and packed up for transport to another location when a camp site is abandoned.

The components of the tent apparatus of the invention can be made from inexpensive and durable metal, plastic, and canvass materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved tent apparatus that is low in cost, relatively simple in design and operation, and which may advantageously be used with considerably less than five support rods. With the invention, a tent apparatus is provided which does not employ an inflatable support structure. With the invention, a tent apparatus is provided which does not need to be suspended from both ends and does not serve as a hammock structure. With the invention, a tent apparatus is provided which is not suspended from a tree. With the invention, a tent apparatus is provided which does not employ arch-shaped structural components. With the invention, a tent apparatus is provided which has a tent front that is not obstructed by tent support structures. With the invention, a tent apparatus is provided which is supported in a way that does not take up floor space inside the tent. With the invention, a tent apparatus is provided which reflects heat and light from a campfire down onto a person lying inside the tent.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, gradations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

What is claimed as being new and desired to be protected by Letters Patent of the United States is as follows:

1. A tent apparatus, comprising:

a pole-support assembly which includes a ground-penetration member, a pole-receiving member connected to said ground-penetration member, and a ground-stabilizing assembly connected between said ground-penetration member and said pole-receiving member, wherein a first portion of said ground-stabilizing assembly is oriented with respect to said ground-penetration member at an acute first orientation angle and wherein a second portion of said ground-stabilizing assembly is oriented with respect to said ground-penetration member at an obtuse second orientation angle, a pole assembly which includes a plurality of interfitting pole segments, wherein a proximal pole segment a is received in said pole-receiving member;

a distal pole portion located at a distal end of said pole assembly, a plurality of suspension cables connected to said distal pole portion, a plurality of primary stakes connected to ends of said suspension cables, wherein said primary stakes are driven into a portion of the ground, and a flexible sheet assembly draped over said suspension cables.

2. The apparatus of claim 1 wherein said ground-penetration member is in a form of a V-shaped blade.

3. The apparatus of claim 1, further including:

sheet-tensioning cables connected to said sheet assembly, and sheet-tensioning stakes connected to ends of said sheet-tensioning cables, wherein said sheet-tensioning stakes are driven in a portion of the ground.

4. The apparatus of claim 1 wherein said pole-receiving member is connected to said ground-penetration member along a common longitudinal axis.

5. The apparatus of claim 1 wherein said first orientation angle and said second orientation angle provide a straight angle when added together.

6. The apparatus of claim 1 wherein said sheet assembly includes:

a first front flap portion which has a first flap edge, a second front flap portion which has a second flap edge, and a connection assembly for connecting said first flap edge to said second flap edge.

7. The apparatus of claim 6 wherein either said first front flap portion or said second front flap portion includes a window flap.

8. The apparatus of claim 6 wherein said sheet assembly includes a roof portion which includes a vent portion.

* * * * *